US006078136A

United States Patent [19]

Sica

[11] Patent Number: 6,078,136

[45] Date of Patent: Jun. 20, 2000

[54] FLUORESCENT LAMP WITH A PROTECTIVE ASSEMBLY HAVING VENT HOLES

[75] Inventor: Michael F. Sica, Greenwich, Conn.

[73] Assignee: Royal Lite Manufacturing and Supply Corp., Elmwood Park, N.J.

[21] Appl. No.: 09/187,950

[22] Filed: Nov. 6, 1998

[51] Int. Cl.[7] ..... H01J 1/62

[52] U.S. Cl. ..... 313/493; 313/25; 313/634

[58] Field of Search ..... 313/493, 25, 26, 313/634, 242, 238

[56] References Cited

U.S. PATENT DOCUMENTS 2,135,696 11/1938 Baumhauer et al. .
2,363,109 11/1944 Keiffer .
2,581,959 1/1952 Koehler .
3,358,167 12/1967 Shanks .
3,453,470 7/1969 Hammer .
3,602,759 8/1971 Evans .
3,720,826 3/1973 Gilmore et al. .
3,808,495 4/1974 Win .
4,048,537 9/1977 Blaisdell et al. .
4,916,352 4/1990 Haim et al. .
4,924,368 5/1990 Northrop et al. ..... 313/110
5,173,637 12/1992 Sica .
5,536,998 7/1996 Sica .
5,729,085 3/1998 Sica et al. .

*Primary Examiner*—Vip Patel
*Attorney, Agent, or Firm*—Baker Botts, L.L.P.

[57] ABSTRACT

An all-weather lamp includes a standard fluorescent lamp and a protective assembly having a protective tube that is preformed from a semi-rigid, non-frangible polymeric transparent or translucent material that is stabilized against ultraviolet radiation and is received over the glass tube with its inner surface substantially uniformly spaced apart from the outer surface of the glass tube to form an air space for insulation of the lamp. The desired uniform spacing between the lamp tube and the protective tube is established by a spacer ring located adjacent each end of the glass tube and adhesively bonded to the glass tube. The protective tube is securely joined to the lamp by a shrink-fitted collar at each end of the lamp that overlaps and is adhesively joined to the protective tube and the lamp terminal cap. A multiplicity of vent holes in portions of the protective tube proximate to the terminal caps of the lamp allow ventilation of the air space between the glass tube and the protective tube. The vent holes are of a size such that if the lamp breaks fragments of the glass tube cannot pass through the holes. There is a sufficient number of holes to enable the lamp to operate without substantial discoloration and without a substantial reduction in light output at ambient temperatures in the range of from about 50° F. to about −30° F.

18 Claims, 1 Drawing Sheet

FLUORESCENT LAMP WITH A PROTECTIVE ASSEMBLY HAVING VENT HOLES

BACKGROUND OF THE INVENTION

When fluorescent lamps break, fragments of the glass tube, mercury, and powders from the phosphor coating inside the lamp are scattered about. In places where food is processed or stored, and particularly in lighted display cabinets in supermarkets where stocking clerks and customers handle food in proximity to the cabinet lamps, it is at least highly desirable, and is often required by government regulations, that the cabinet lamps be protected in a way that minimizes the possibility of the lamps being broken and if they do break that the possibility of glass fragments, mercury, and phosphor powders escaping and contaminating the food be eliminated. Fluorescent lamps with a protective assembly are known and widely used for this purpose. Examples of such lamps are those described and shown in U.S. Pat. No. 4,048,537 (Blaisdell et al., 1977), U.S. Pat. No. 4,924,368 (Northrup et al., 1990), U.S. Pat. No. 5,173,637 (Sica, 1992), U.S. Pat. No. 5,536,998 (Sica, 1996) and U.S. Pat. No. 5,729,085 (Sica, 1998). The three Sica patents are owned by the assignee of the present invention.

Store display cabinets for frozen foods present, in addition to the need for minimizing the possibilities of lamp breakage and escape of glass and powders, a requirement for maintaining the optimum light output of the lamp in the low temperature environment; fluorescent lamps designed to operate at ambient room temperature—about 70° F.—provide much less light output at low ambient temperatures than they provide at room temperature. There have, accordingly, been numerous proposals for adapting fluorescent lamps for low-temperature operation, such as those disclosed in the following U.S. Pat. No. 2,135,696 (Baumhauser et al., 1938); U.S. Pat. No. 2,363,109 (Keiffer, 1944); U.S. Pat. No. 2,581,959 (Koehler, 1952); U.S. Pat. No. 3,358,167 (Shanks, 1967); U.S. Pat. No. 3,453,470 (Hammer, 1969); U.S. Pat. No. 3,602,759 (Evans, 1971); U.S. Pat. No. 3,720,826 (Gilmore et al., 1973); and U.S. Pat. No. 4,916,352 (Haim et al., 1990).

In most instances, the prior art protective assemblies for fluorescent lamps include special molded end fittings that fit onto the terminal caps of the lamp and hold a protective sleeve in place on the lamp. In some cases, the end fittings are intentionally designed so that they can be removed from the lamp, thus allowing the protective assembly to be reused as lamps burn out and are replaced. Removable protective assemblies do not fully ensure that glass fragments and phosphor powders are retained in case the lamp breaks. Regardless of whether the end fittings are permanently attached to the lamp or are removable, they are relatively expensive and usually have to be designed for a specific lamp style to ensure a proper fit.

The lamp of the Sica '637 patent (referred to above) provides excellent protection against breakage of the lamp, and if the lamp should break, the protective assembly provides an enclosure that is secure against scattering of glass fragments and phosphor powders. In that regard, a protective tube over the lamp tube is securely joined to the terminal caps of the lamp by collars that both mechanically engage and are adhesively secured to the protective tube and the terminal caps. The lamp of the Sica '637 patent is inexpensive to produce, inasmuch as it uses simple tubular elements and commercially available adhesives.

The Sica '998 patent, which is also referred to above, relates to a protected fluorescent lamp that is constructed to operate in cold environments, such as supermarket freezer cabinets and chests or in outdoor environments in cold weather. It uses a standard "room temperature" (70° F.) fluorescent lamp and has a protective tube held in radially spaced-apart relation to the glass tube of the lamp by a compressible foam spacer ring at each end. The spacing between the glass tube of the lamp and the protective tube provides an air gap between the lamp tube and the protective tube. The air trapped in the air gap provides an insulating layer for restricting heat transfer from the lamp to the ambient air outside the protective tube and for circulation of air for convective distribution of heat along the length of the lamp. The retention of heat in the air gap prevents the lamp from cooling, thereby maintaining the light output at or close to the output of the lamp at room temperature. The protective tube absorbs impacts and minimizes the possibility of the lamp being broken. Should the lamp break, the shrink fit collars, which are joined to the flanges of the lamp terminal caps and the protective tube by an adhesive as well as by mechanically engaging the flanges and the protective tube, maintain the integrity of an enclosure, which is composed of the protective tube, the collars, and the terminal caps, for containment of lamp fragments and phosphor powders.

The foam spacer ring provides several functions. First, it is a spacer for the protective tube from the glass tube of the lamp, in that it establishes the air gap uniformly with respect to the lamp tube at each end. Because the protective tube is substantially rigid, the uniformity of the air gap along the entire length of the lamp is ensured by establishing the gap at each end. Second, the foam spacer rings provide thermal insulation at the ends of the air gap and prevent cold spots from forming where the protective tube ends. Third, the foam spacer rings provide impact-absorbing cushions between the protective tube and the lamp tube, this reducing the possibility of impacts to the tube, especially near the ends, causing the lamp to fracture. The spacer rings are joined to the lamp tube by an adhesive, thus ensuring that they will stay in place, not only when the protective tube is slid over the lamp when the protective assembly is installed on the lamp but throughout the life of the lamp. The fit between the spacer ring and the protective tube is a "snug fit," in order to enhance the insulating function but to avoid stressing the lamp tube and to permit sliding the protective tube over the lamp with the spacer rings already in place. Because the ring is a compressible foam, slight compression is possible without making it difficult to slide the protective tube over the lamp.

The Sica '998 and '637 patents are hereby incorporated into the present document for all purposes.

Lamps with protective assemblies according to the Sica '998 patent, which are commercially available, work very well in the cold temperatures for which they are intended, namely, in a range of temperatures from freezing (32° F.) to −30° F. In the higher part of the range and at temperatures above freezing, those lamps tend to overheat, which reduces their lives, and the end portions of the protective covers may exhibit discoloration over time, which reduces the light output. In some environments, such as cold cabinets for produce, dairy products, some salad dressings, and other products that are kept chilled but somewhat above freezing, protected lamps according to the Sica '998 patent, do not serve well. On the other hand, protected room temperature lamps, such as those of the Sica '637 patent are also unsatisfactory due to reduced light output at temperatures below about 50° F.

SUMMARY OF THE INVENTION

An object of the present invention is to provide a protected lamp assembly that can be used over a wider range of temperatures than the lamps of either the Sica '637 patent or the Sica '998 patent. In particular, it is an object of the present invention to provide a protected lamp assembly for use in the range of temperatures from about 50° F. to about −30° F. That range permits the same protected lamp assembly to be used, for example, in both chilling cabinets and freezer cabinets.

The foregoing and other objects are attained, according to the present invention, by an improvement in a protective assembly for a standard fluorescent lamp of the type having an elongated glass tube and a metal terminal cap at each end of the glass tube, each cap having a flange portion adjacent the glass tube. The assembly includes a protective tube that is preformed from a semi-rigid non-frangible polymeric transparent or translucent material that is stabilized against ultraviolet radiation and is received over the glass tube with its inner surface substantially uniformly spaced apart from the outer surface of the glass tube to form an air space for insulation of the lamp. The protective tube is substantially coextensive with the full diameter portion of the glass tube lengthwise of the lamp and is fastened to the flange portions of the lamp so that in the event that the lamp breaks, the protective tube remains fastened to the end caps.

The improvement is the provision of a multiplicity of vent holes in portions of the protective tube proximate to the end caps. The vent holes are of a size such that fragments of glass from a broken lamp tube can not pass through them. The number of vent holes is such that the air gap between the glass tube of the lamp and the protective tube is vented to permit the lamp to operate without substantial reduction in light output and without substantial discoloration of the protective tube in the range of ambient temperatures of from about 50° F. to −30° F.

Two important aspects of the improvement, according to the present invention, are: (1) the vent holes are small enough to prevent the escape of solid materials, such as fragments of broken glass and phosphor particles, from the intact protective tube/terminal cap structure in the event that the glass tube of the lamp breaks; (2) the holes are arranged and are sufficient in number to allow limited ventilation of the air space between the glass tube of the lamp and the protective tube. Although it is not readily possible to quantify the degree of ventilation and no effort has been made to do so, it can be said that too much ventilation will cause the lamp to operate at too low a temperature, thus significantly reducing the light output; too little ventilation will cause the lamp to operate at too high a temperature, which can cause discoloration of the protective tube, especially near the ends where the temperatures of the lamp are highest. The right amount of ventilation can be determined by experimentation, which has been done for the embodiment described below.

In particular, it has been found that vent holes having a diameter of about 0.050 inch are small enough to prevent solid materials (as opposed to gases) from escaping from the protective enclosure formed by the protective tube and the end terminals in the event that the glass tube of the lamp breaks. The holes in each end portion of the protective tube should be evenly distributed circumferentially of the protective tube. Good results have been obtained with all of the vent holes located within about three inches from each end of the protective tube. For example, tests have established that lamp life and lamp light output of a protected lamp operated at various ambient temperatures between 50° F. and −30° F. are maintained close to those of the standard (unprotected) lamp operating at room temperature with 72 vent holes of 0.050 inch diameter in each end portion of the protective tube, the vent holes being arranged in three circumferential rows of 24 equally spaced-apart vent holes each and the rows spaced-apart ⅞ ths inch from each other.

For a better understanding of the invention reference may be made to the following description of an exemplary embodiment, taken in conjunction with the accompanying drawings.

DESCRIPTION OF THE EMBODIMENTS

Figure 1:
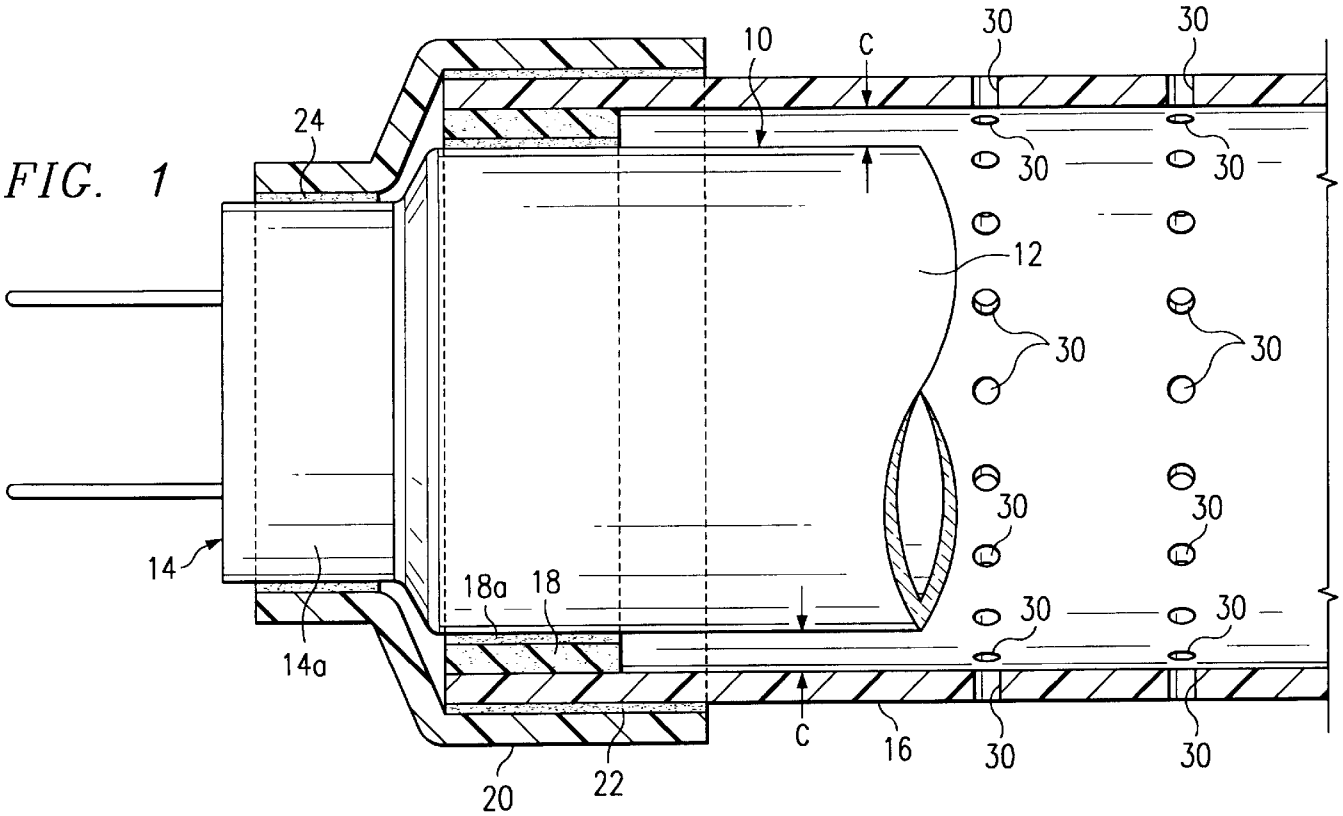
FIG. 1 is a side cross-sectional view of one end of an embodiment of a protective assembly as installed on a conventional fluorescent lamp and is also a mirror image of the other end, both ends being of the same construction.
Figure 2:
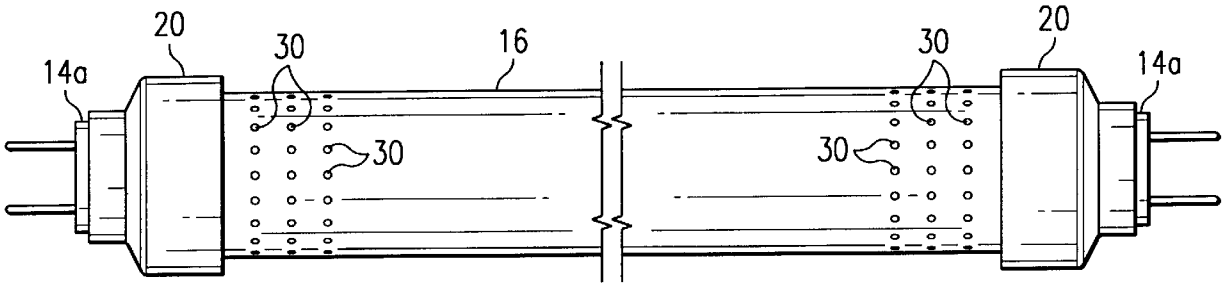
FIG. 2 is a side elevational view of an embodiment of a protected lamp embodying the present invention, a center portion being broken away.

Referring first to FIG. 1, reference numeral 10 designates a conventional, commercially available, room temperature fluorescent lamp of the type having an elongated glass tube 12 that necks down slightly at each end and is closed at each end by a metal cup-like terminal cap 14 having a peripheral flange portion 14*a*. The lamp bases may be of the conventional bi-pin (as shown), single pin or recessed double contact type. The protective assembly consists of a protective tube 16 preformed from a semi-rigid non-frangible transparent polymeric material that is received over the glass tube with a clearance "C" between the outer surface of the glass tube and the inner surface of the protective tube and extends lengthwise substantially coextensively with the glass tube. The clearance or gap "C" between the lamp tube and the protective tube is established and maintained by a spacer ring 18, there being a spacer ring 16 located adjacent each end of the glass tube. Each spacer ring is adhesively bonded to the glass tube by an adhesive layer 18*a*, is formed of a semi-rigid polymeric foam strip material that is resistant to heat and ultraviolet radiation, and is in the form of a band of substantially uniform rectangular cross-section and having a thickness such that an outer surface of the ring forms a snug fit with an inner surface of the protective tube so that the protective tube can be slid lengthwise onto the lamp. A collar 20 preformed from a heat-shrinkable polymeric material is received in overlapping relation over a portion of the protective sleeve at each end thereof and over the flange portion of the adjacent cap. The collar 20 is heat-shrunk into sealed relation with the protective tube 16 and the cap flange portion 14*a*. A layer 22 of an adhesive is interposed between each collar 20 and the corresponding end of the protective tube 16, and an adhesive layer 24 is interposed between each collar 20 and the corresponding cap flange portion 14*a*. No adhesive is present between the glass tube of the lamp and the collars 20.

In a specific example of the invention, as applied to a 1.50 in. diameter fluorescent tube, the protective tube 16 is a piece cut to a length such as to extend lengthwise over the full diameter portion of the lamp tube (but not over the necked-down parts at either end) from an extrusion of a polycarbonate resin that is highly stabilized against ultraviolet radiation. The protective tube may be clear or translucent and in either case may be colored. A suitable clear polycarbonate tubing is available commercially from Thermoplastic Processors, Incorporated, of Sterling, N.J., as Product No. 58UV, which is manufactured from a resin is supplied by Mobay, Incorporated (Resin No. 3207-1112M50). The protective tube has a wall-thickness of 0.0625 inch and an inside diameter of 1 13/16 inch. On the radius, the clearance or gap between the outside of the glass tube and the inside of the protective tube is 3/32 inch. The clearance is desirable in that it provides a thermal insulating barrier of air between the glass tube of the lamp and the protective tube that maintains a desirable temperature differential between the lamp tube and the environment outside the protective tube. The gap also allows for flow of convective air currents for maintaining a desirable heat gradient along the length of the lamp.

The spacer rings 18 are strips of silicone rubber foam of substantially uniform, rectangular cross section, having a width of ½ inch and a thickness of ¼ inch. The foam has a compression deflection of from about 6 to about 14 psi at 25% compression (ASTM D1056). It has an acrylic adhesive coating applied to one face and a release liner over the adhesive. To form the ring, a piece of the foam tape is precut from a supply roll to the required length to wrap around the lamp tube and form a snug butt joint where the two ends meet. The tape is applied to the lamp so that its edge nearer the lamp terminal cap substantially coincides with the end of the protective tube.

The collars 20 are pieces cut to a length of 1½ inch from a tubing product available commercially from E. H. Canis & Son, Inc., of Metuchen, N.J., under the trademark "Astramelt FP301." About ¾ inch of the collar overlaps the protective tube. The adhesive is GE PSA and provides additional mechanical retention over and above that provided by shrinking the collar and also provides a moisture barrier and hermetic seal between the lamp and the protective assembly.

If the protected lamp breaks, the protective assembly retains the caps and prevents the dispersal of glass fragments and phosphor powders. The protective assembly does not appear to reduce the light transmission, because the protective tube is entirely transparent.

To enable the protected lamp to operate properly at temperatures as high as about 50° F. without a reduced life or discoloring of the protective tube 16 near the ends where the lamp is hottest, vent holes 30 are provided in each end portion of the protective tube 16. In the embodiment all of the vent holes 30 are of the same diameter, 0.050 inch. It has been determined that holes of that size are small enough to prevent the escape of glass fragments from the glass tube and phosphor particles and mercury that are released from within the tube when the glass tube of the lamp breaks. The vent holes are evenly distributed circumferentially of the protective tube, thus avoiding possibly uneven venting action, depending on the orientation of the protected lamp. The number of holes required to keep the operating temperature of the lamp low enough to avoid problems at ambient temperatures as high as 50° F. is about 72 in each end portion of the protective tube. A suitable arrangement of the holes is three circumferential rows spaced apart about ⅞ th inch, and with the row closest to the end of the protective tube ⅞ th inch from the end.

The foregoing specific configuration is intended to serve as guidance. It is apparent that different hole patterns, different numbers of holes, holes slightly larger or smaller than 0.050 inch can be used with good results. Any arrangement of holes of a size that provides retention of glass fragments, phosphor particles and mercury from a broken lamp and of a number and postioning in the protective tube that provides ventilation to keep the lamp from overheating at temperatures up to 50° F. is suitable. It has been determined that the vent holes do not materially alter the good performance of the protected lamp at temperaures as low as −30° F.

One aspect of the retention of materials released by a lamp that has the protective assembly described above is that if a lamp breaks, the pressure within the protective assembly initially drops to a level well below atmospheric, because the low vacuum volume within the lamp is added to the volume of the air gap. Therefore, air flows into the confined volume provided by the terminal caps and the protective tube through the vent holes. The inflow of air prevents materials within the confined volume from being released through the vent holes. Although the pressure within the confined volume reaches atmospheric soon after a lamp breaks, the presence of the vent holes does not alter the effectiveness of the protective assembly in preventing elements of the lamp from being released to the environment because of the induction of air through the vent holes.

What is claimed is:

1. In a fluorescent lamp with a protective assembly, the lamp having an elongated glass tube and a metal terminal cap at each end of the glass tube and each cap having a flange portion adjacent the glass tube, and the protective assembly having a protective tube preformed from a semi-rigid non-frangible polymeric transparent or translucent material that is stabilized against ultraviolet radiation, the protective tube being received over the glass tube, being joined at the ends to the flange portions of the terminal caps, having an inner surface substantially uniformly spaced apart from an outer surface of the glass tube to form an air space for insulation of the lamp, and being substantially coextensive with the glass tube lengthwise of the lamp, the improvement wherein there is a multiplicity of vent holes in portions of the protective tube proximate to the terminal caps of the lamp, the vent holes being of a size such that if the lamp breaks fragments of the glass tube cannot pass through the holes and the number of holes being sufficient to enable the lamp to operate without substantial discoloration and without a substantial reduction in light output at ambient temperatures in the range of from about 50° F. to about −30° F.

2. The improvement according to claim 1 wherein each of the vent holes has a diameter of about 0.050 inch.

3. The improvement according to claim 1 wherein the vent holes are distributed substantially evenly about the circumference of the protective tube.

4. The improvement according to claim 1 wherein each of the vent holes has a diameter of about 0.050 inch and the vent holes are distributed substantially evenly about the circumference of the protective tube.

5. The improvement according to claim 4 wherein the vent holes are arranged in circumferential rows and the vent holes in each row are substantially equally spaced apart from each other.

6. The improvement according to claim 4 wherein the vent holes in each end portion of the protective tube are located within about three inches from the end of the protective tube.

7. The improvement according to claim 4 wherein there are about 72 vent holes in each end of the protective tube.

8. The improvement according to claim 1 wherein each of the vent holes has a diameter of about 0.050 inch and the vent holes in each end portion of the protective tube are arranged in three circumferential rows, the rows being substantially equally spaced apart and each row having about 24 vent holes equally spaced-apart from each other.

9. The improvement according to claim 8 wherein the row closest to the nearer end of the protective tube is about seven-eighths inch from the nearer end and the rows are spaced apart from each other about seven-eighths inch.

10. In a fluorescent lamp with a protective assembly, the lamp having an elongated glass tube and a metal terminal cap at each end of the glass tube and each cap having a flange portion adjacent the glass tube, and the protective assembly having a protective tube preformed from a semi-rigid non-frangible polymeric transparent or translucent material that is stabilized against ultraviolet radiation, the protective tube being received over the glass tube and having an inner surface substantially uniformly spaced apart from an outer surface of the glass tube to form an air space for insulation of the lamp and being substantially coextensive with the glass tube lengthwise of the lamp, a spacer ring located adjacent each end of the glass tube and adhesively bonded to the glass tube, each spacer ring being formed of a semi-rigid polymeric foam strip material that is resistant to heat and ultraviolet radiation, and a collar at each end of the lamp, each collar having a first portion received over an end portion of the protective tube and a second portion received over the flange portion of the cap, each collar being preformed of a heat-shrinkable polymeric material and being heat-shrunk into sealed relation with and being adhesiveoly bonded to the protective tube and the cap flange portion, the improvement wherein there is a multiplicity of vent holes in portions of the protective tube proximate to the terminal caps of the lamp, the vent holes being of a size such that if the lamp breaks fragments of the glass tube cannot pass through the holes and the number of holes being sufficient to enable the lamp to operate without substantial discoloration and without a substantial reduction in light output at ambient temperatures in the range of from about 50° F. to about −30° F.

11. The improvement according to claim 10 wherein each of the vent holes has a diameter of about 0.050 inch.

12. The improvement according to claim 11 wherein the vent holes are distributed substantially evenly about the circumference of the protective tube.

13. The improvement according to claim 10 wherein each of the vent holes has a diameter of about 0.050 inch and the vent holes are distributed substantially evenly about the circumference of the protective tube.

14. The improvement according to claim 13 wherein the vent holes are arranged in circumferential rows and the vent holes in each row are substantially equally spaced apart.

15. The improvement according to claim 13 wherein the vent holes in each end portion of the protective tube are located within about three inches from the end of the protective tube.

16. The improvement according to claim 13 wherein there are about 72 vent holes in each end of the protective tube.

17. The improvement according to claim 10 wherein each of the vent holes has a diameter of about 0.050 inch and the vent holes in each end portion of the protective tube are arranged in three circumferential rows, the rows being substantially equally spaced apart and each row having about 24 vent holes equally spaced-apart from each other.

18. The improvement according to claim 17 wherein the row closest to the nearer end of the protective tube is about seven-eighths inch from the nearer end and the rows are spaced apart from each other about seven-eighths inch.

* * * * *